US006252150B1

(12) United States Patent
Johnson

(10) Patent No.: US 6,252,150 B1
(45) Date of Patent: Jun. 26, 2001

(54) GUITAR FULCRUM

(76) Inventor: Timothy L. Johnson, 880 Marion #2, Denver, CO (US) 80218

( * ) Notice: Subject to any disclaimer, the term of this patent is extended or adjusted under 35 U.S.C. 154(b) by 0 days.

(21) Appl. No.: 09/541,256

(22) Filed: Apr. 3, 2000

(51) Int. Cl.[7] ..... G10D 3/00
(52) U.S. Cl. ..... 84/327; 84/421; 84/453
(58) Field of Search ..... 84/327, 421, 453, 84/387 A, 280

(56) References Cited

U.S. PATENT DOCUMENTS

| | | | | |
|---|---|---|---|---|
| 2,814,229 | * | 11/1957 | Vaccaro et al. | 84/327 |
| 3,955,461 | * | 5/1976 | Ivie | 84/327 |
| 4,966,062 | * | 10/1990 | Driggers et al. | 84/327 |
| 5,388,492 | * | 2/1995 | Olson | 84/327 |

FOREIGN PATENT DOCUMENTS

625636 * 9/1981 (CH) .

* cited by examiner

*Primary Examiner*—Shih-Yung Hsieh

(74) *Attorney, Agent, or Firm*—Edwin H. Crabtree; Ramon L Pizarro; Donald W. Margolis

(57) ABSTRACT

A guitar fulcrum used for releasable attachment to a body of a guitar and holding the guitar above a guitar player's leg when the player is in a seated position. The guitar fulcrum allows for adjusting and moving the guitar, as in a gimbal, prior to playing or during the playing of the guitar. The guitar fulcrum includes a curved leg pad with soft cushion material adapted for receipt on a top portion or a side portion of the player's leg. A leg pad tang is rotatably mounted 360 degrees on top of the leg pad. The tang allows the guitar to be rotated in a horizontal "XZ" plane to the player's left or right. A yoke, with a yoke pivot pin, is pivotally mounted on the tang. The yoke allows the guitar to be rotated in vertical "YZ" plane toward or away from the player's body. One end of a pair of height adjustment struts, using strut pivot pins, is pivotally mounted on the yoke. An opposite end of the struts is attached to a suction cup pivot pin. The suction cup pivot pin is attached to at least one or more suction cups. The suction cups are used for releasable attachment to a portion of the guitar body. The struts allow the guitar to be raised and lowered in a "XY" vertical plane above the musician's leg. The fulcrum with leg pad provides for improved acoustics by eliminating direct engagement of the guitar body against the leg.

12 Claims, 2 Drawing Sheets

GUITAR FULCRUM

BACKGROUND OF THE INVENTION (a) Field of the Invention

This invention relates to an accessory for a musical string instrument and more particularly, but not by way of limitation to a fulcrum for mounting on the side of a guitar, a banjo and like string instruments.

(b) Discussion of the Prior Art

Heretofore, there have been a variety of different types of attachments for musical string instruments. In U.S. Pat. No. 491,755to LeValley, an arm rest and support for guitars is described. The support is designed to rest the right arm thereon and allow the left arm to be free to perform fingering without holding a portion of the weight of the guitar. In U.S. Pat. Nos. 914,660 to Hartnett and 1,020,491 to Gough, a hand support and an arm rest for banjo players are described. In U.S. Pat. Nos. 1,753,006 to Haaf and 3,619,470 to Harris, a wrist support and a hand position device for violinists are described.

In U.S. Pat. No. 4,966,062, an A-frame guitar support is described for holding a guitar above the leg of a musician. The support includes A-frame arms attached to an adjustable leg strap. The support also includes a height adjustment arm for raising and lowering the guitar. This type guitar support, when attached to the guitar, does not allow the player to pivot or rotate the instrument in either a vertical or horizontal plane.

In U.S. Pat. No. 6,005,175, to the subject inventor, a guitar fulcrum is described for use as an elbow rest. The guitar fulcrum includes an ergonomically designed elbow pad adapted for engaging a portion of the musician's elbow. The guitar fulcrum is adjustably mounted on the hip of the body of a guitar and provides for proper placement of a player's fingers on the guitar strings adjacent a sweet spot above the sound hole of the guitar.

None of the above mentioned patents describe the unique features, structure and advantages of the subject guitar fulcrum for holding a guitar and like musical instruments above a leg of a musician and allowing freedom of movement of the guitar when the player is in a seated position.

SUMMARY OF THE INVENTION

In view of the foregoing, it is a primary object of the subject invention to provide a guitar fulcrum for holding a guitar, banjo and like musical instruments above a leg of a musician when the player is seated and allowing freedom of movement, as in a gimbal, in a 3 dimensional plane when playing the guitar. Also, the guitar fulcrum provides added comfort and helps reduce lower back problems when holding the instrument in a seated position. A leg pad with gripping surface is designed to help prevent the fulcrum from slipping off of the leg of the player.

Another object of the guitar fulcrum is to improve the acoustics of the musical instruments by preventing the body of the guitar from contacting the side of player's leg. The invention can also be used in conjunction with a guitar fulcrum with elbow rest used for proper placement of the player's hand on the sweetspot above the sound hole of the guitar body.

Still another object of the invention is the guitar can be raised or lowered above the player's leg in a vertical plane in front of the player and holding the guitar in various upright positions prior to playing the guitar or when playing the guitar.

Yet another object of the fulcrum is the guitar can be moved away from the player's body or moved toward the player's body in a vertical plane.

A further object of the guitar fulcrum is the guitar can be rotated to the player's left or right in a horizontal plane.

The guitar fulcrum includes a curved leg pad with soft cushion material adapted for receipt on a top portion or side portion of a player's leg. A leg pad tang, mounted on top of a washer, is rotatable 360 degrees on top of the leg pad. The leg pad tang allows the guitar to be rotated to the player's left or right and in a horizontal "XZ" plane.

A yoke, with a yoke pivot pin, is pivotally mounted on the leg pad tang. The yoke allows the guitar to be pivoted toward the player's body or away from the body in a vertical "YZ" plane.

A lower end of a pair of height adjustment struts is pivotally mounted on the yoke using a strut pivot pin. An upper end of the two struts is attached to a suction cup pivot pin. The suction cup pivot pin is attached to at least one or more suction cups.

The suction cups are used for releasable attachment to a portion of the guitar body. The struts allow the guitar to be raised and lowered above the player's leg in a vertical "XY" plane.

These and other objects of the present invention will become apparent to those familiar with different types of musical instrument holders, fulcrums and stands used in holding string instruments when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figures 1, 2:
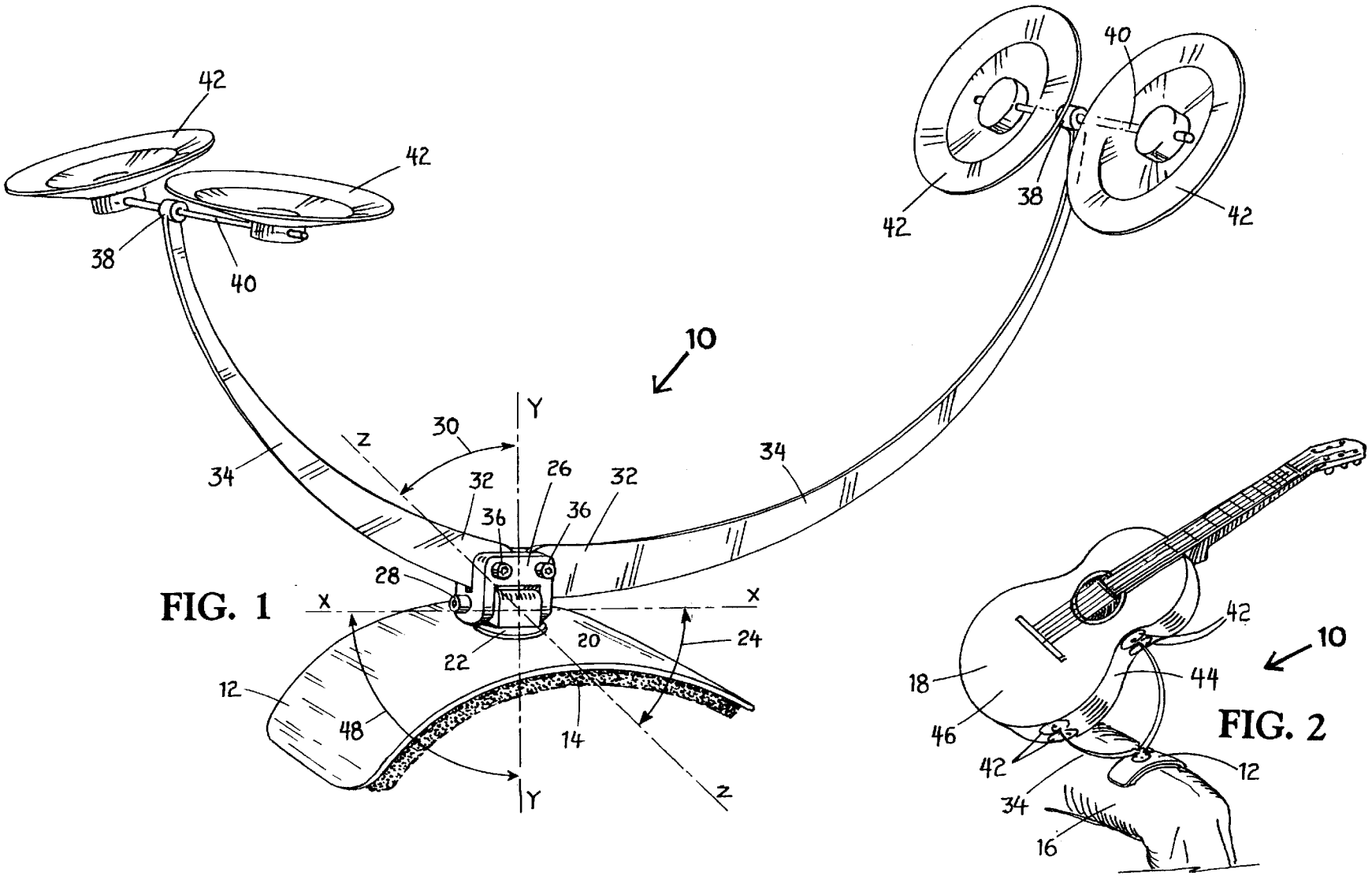
FIG. 1 is a perspective view of the subject guitar fulcrum and illustrating the structure and function of the fulcrum and movement of the fulcrum in a three dimensional plane along an "X", "Y" and "Z" axis.
FIG. 2 is a perspective view of the guitar fulcrum attached to the side of a body of a guitar with the leg pad resting on a top portion of a player's leg.

In FIG. 1, a perspective view of the subject guitar fulcrum is illustrated and showing the structure of the fulcrum and movement of the fulcrum in a three dimensional plane along an "X", a "Y" and a "Z" axis. The "X" axis perpendicular to the "Y" and "Z" axis. The "Y" axis perpendicular to the "X" and "Z" axis. The "X" and "Y" axis defining a vertical plane. The "Y" and "Z" axis defining a vertical plane. The "X" and "Z" axis defining a horizontal plane. The guitar fulcrum is designated by general reference numeral 10.

The guitar fulcrum 10 includes a curved leg pad 12 with a soft cushion material 14 such as open cell or closed cell sponge rubber and like materials. The leg pad 12 is adapted for receipt on a top portion or a side portion of a player's leg 16. The player's leg 16 and guitar 18 are shown in FIGS. 2–5 and 6A–6D. The cushion material 14 provides for added comfort when resting the guitar 18 or like musical instrument on the leg 16 of the musician. Also, the cushion material 14 on the leg pad 12, provides a gripping surface to prevent the fulcrum 10 from slipping off of the leg 16.

A leg pad tang 20, mounted on top of a washer 22, is rotatably mounted 360 degrees on top of the leg pad 16. The tang 20 is attached to the leg pad 16 by a threaded tang pivot pin extending upwardly from the bottom of the leg pad 16, through the washer 22 and engaging the bottom of the tang 20. The tang pivot pin is not shown in the drawings. The tang pivot pin is designed to be tightened by hand to hold the tang 20 in place or the tang pivot pin can be loosened to allow the tang 20 to rotate freely during the use of the fulcrum 10. The leg pad tang 20 allows the guitar 18 to be rotated to the player's left or right, as indicated by arrow 24, and in a horizontal "XZ" plane when attached to the fulcrum 10. The three axis "X", "Y" and "Z" mentioned above intersect as shown in FIG. 1 above the leg pad 16 and through the center of the tang 20.

A yoke 26, with a yoke pivot pin 28, is pivotally mounted on the leg pad tang 20. The yoke 26 allows the guitar 18 to be pivoted toward the player's body or away from the body, as indicated by arrow 30, in a vertical "YZ" plane. The yoke pivot pin 28 is also tightened by hand to prevent the movement of the yoke 26 or the yoke pivot pin 28 can be loosened to allow the yoke to pivot freely during the playing of the guitar 18.

A lower end 32 of a pair of height adjustment struts 34 is pivotally mounted on the yoke 26 using strut pivot pins 36. The strut pivot pins 36 are also tightened by hand to prevent the movement of the struts 34 or the strut pivot pins 36 can be loosened to allow the struts 34 to pivot freely during the playing of the guitar 18. The adjustable struts 34 allow the guitar 18 to be raised and lowered, as indicated by arrow 48, above the player's leg 16 in an "XY" vertical plane. The pivoting of the struts 34, the pivoting of the yoke 26 and the rotating of the tang 20 provide a gimbal effect in the movement of the guitar 18 on the fulcrum 10.

An upper end 38 of the struts 34 is attached to a suction cup pivot pin 40. The suction cup pivot pin 40 is attached to at least one or more suction cups 42. In this drawing, a pair of suction cups 42 are shown attached to opposite ends of the pivot pins 40. The suction cups 42 are used for releasable attachment to a portion of a side 44 of a guitar body 46, as shown in FIG. 2. While the suction cups 42 are shown in the drawings, it can be appreciated that various types of attachment devices can be used equally well without departing from the spirit and scope of the invention as described herein.

In FIG. 2, a perspective view of the guitar fulcrum 10 is shown attached to the side 44 of the guitar body 46 of the guitar 18. The leg pad 16 is illustrated resting on a top portion of the player's leg 16. The suction cups 42 are shown attached to the side 44 of the guitar body 46 next to the waist and hip of the guitar 18 with a length of the guitar held upwardly at approximately 45 degrees from the horizontal.

Figure 3:
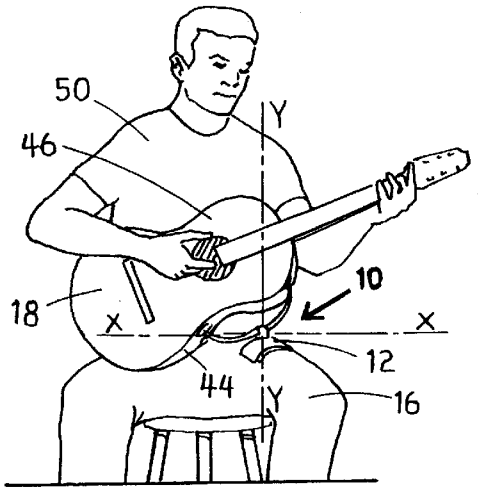
FIG. 3 is a front perspective view of a guitar player in a seated position with the guitar fulcrum attached to the side of the body of the guitar with a length of the guitar in a lowered position slightly above the horizontal.

In FIG. 3, a front perspective view of a guitar player 50 is shown in a seated position. The guitar fulcrum 10 is attached to the side 44 of the body 46 of the guitar 18 with a length of the guitar in a lowered position slightly above the horizontal. In this drawing and FIGS. 4 and 5, the guitar is raised and lowered on fulcrum 10 in the "XY" vertical plane. Also, the suction cups are attached at various position, as shown in FIGS. 3–5, along side 44 of the guitar 18.

Figure 4:
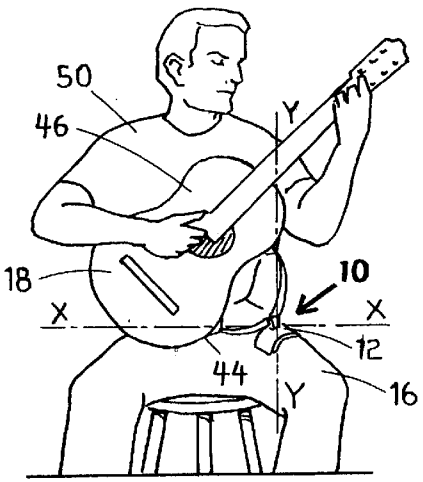
FIG. 4 is a front perspective view of the guitar player in the seated position with the guitar fulcrum attached to the side of the body of the guitar with the length of the guitar in a raised standard playing position and at an angle of approximately 45degrees from the horizontal.

In FIG. 4, another front perspective view of the guitar player 50 is shown in the seated position. In this drawing, the guitar fulcrum 10 is attached to the side 44 of the body 46 of the guitar 18 with the length of the guitar in a raised standard playing position and at an angle of approximately 45 degrees from the horizontal.

Figure 5:
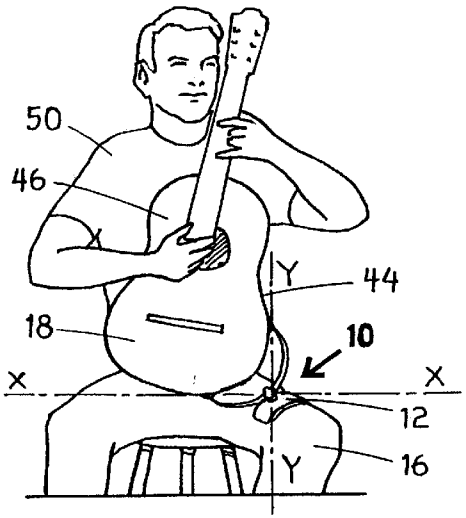
FIG. 5 is a front perspective view of the guitar player in the seated position with the guitar fulcrum attached to the side of the body of the guitar with the length of the guitar in a raised playing position similar to a position for playing a cello and at an angle upwardly toward a vertical position.

In FIG. 5, still another front perspective view of the guitar player 50 is shown in the seated position. In this drawing, the guitar fulcrum 10 is attached to the side 44 of the body 46 of the guitar 18 with the length of the guitar in a raised playing position similar to a position for playing a cello and at an angle upwardly toward a vertical position.

Figure 6D:
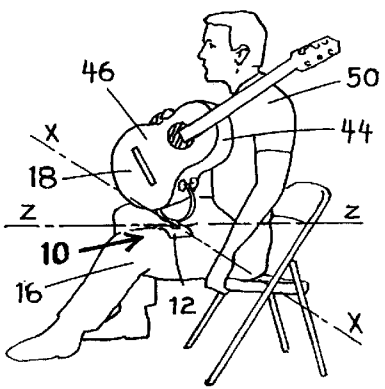
FIG. 6D is a side perspective view of the guitar player in the seated position with the guitar fulcrum used to rotate the guitar to the left of the player.
Figure 6C:
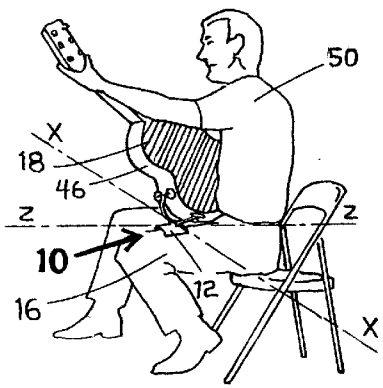
FIG. 6C is a side perspective view of the guitar player in the seated position with the guitar fulcrum used to rotate the guitar to the right of the player.
Figure 6B:
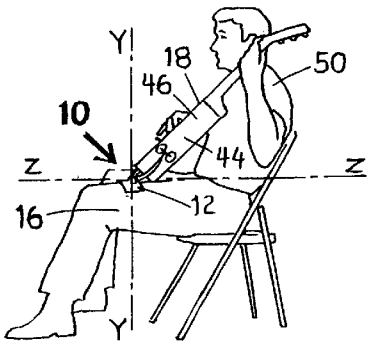
FIG. 6B is a side perspective view of the guitar player in the seated position with the guitar fulcrum used to pivot the guitar inwardly toward the body of the player.
Figure 6A:
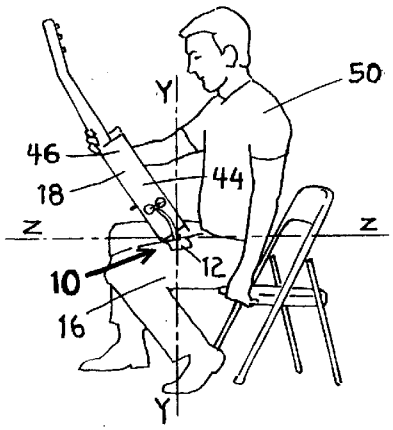
FIG. 6A is a side perspective view of the guitar player in the seated position with the guitar fulcrum used to pivot the guitar outwardly away from the body of the player.

In FIG. 6A, a side perspective view of the guitar player 50 is shown in the seated position. In this drawing, the guitar fulcrum 10 is used to pivot the guitar outwardly away from the body of the player and in vertical "YZ" plane.

In FIG. 6B, another side perspective view of the guitar player 50 is shown in the seated position. In this drawing, the guitar fulcrum 10 is used to pivot the guitar inwardly and toward the body of the player and in vertical "YZ" plane.

In FIG. 6C, a side perspective view of the guitar player 50 is shown in the seated position. In this drawing, the guitar fulcrum 10 used to pivot the guitar to the right of the player and in a horizontal "XZ" plane.

In FIG. 6D, another side perspective view of the guitar player 50 is shown in the seated position. In this drawing, the guitar fulcrum 10 used to pivot the guitar to the left of the player and in the horizontal "XZ" plane.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A guitar fulcrum used for attachment to a body of a guitar and holding the guitar above a guitar player's leg when the player is in a seated position, the guitar fulcrum comprising:

a curved leg pad adapted for receipt on a top portion or a side portion of the player's leg;

a pair of struts, said struts having a lower end and an upper end, the upper end of said struts adapted for attachment to the guitar;

a yoke, the lower end of said struts pivotally attached to said yoke;

a tang, said tang mounted on and rotatable on a top surface of said leg pad, said yoke pivotally attached to said tang.

2. The guitar fulcrum as described in claim 1 further including threaded strut pivot pins used for attaching the lower end of said struts to said yoke, whereby when said strut pivot pins are loosened, said struts are free to pivot upwardly and downwardly in an "XY" vertical plane.

3. The guitar fulcrum as described in claim 1 further including a threaded yoke pivot pin used for attaching said yoke on said tang, whereby when said threaded yoke pivot pin is loosened, said yoke is free to pivot forward and backward in an "YZ" vertical plane.

4. The guitar fulcrum as described in claim 1 further including a threaded tang pivot pin used for attaching said tang on top of said leg pad, whereby when said threaded tang pin is loosened, said tang is free to rotate 360 degrees on top of said leg pad in an "XZ" horizontal plane.

5. The guitar fulcrum as described in claim 1 further including at least one suction cup attached to the upper end of said struts, said suction cup adapted for attachment to the guitar.

6. A guitar fulcrum used for attachment to a body of a guitar and holding the guitar above a guitar player's leg when the player is in a seated position, the guitar fulcrum allowing when playing the guitar to pivot upwardly and downwardly in an "XY" vertical plane, to pivot forward and backward in an "YZ" plane and to rotate to the left and the right in an "XZ" horizontal plane, the fulcrum comprising:

a curved leg pad adapted for receipt on a top portion or a side portion of the player's leg;

a pair of struts, said struts having a lower end and an upper end, the upper end of said struts adapted for attachment to the guitar;

a yoke, the lower end of said struts pivotally attached to said yoke; whereby said struts when pivoted move upwardly and downwardly in an "XY" vertical plane;

a tang, said tang mounted on and rotatable on a top surface of said leg pad, whereby said tang when rotated moves in an "XZ" horizontal plane, said yoke pivotally attached to said tang, whereby said yoke when pivoted moves in an "YZ" vertical plane.

7. The guitar fulcrum as described in claim 6 further including threaded strut pivot pins used for attaching the lower end of said struts to said yoke, whereby when said strut pivot pins are loosened, said struts are free to pivot upwardly and downwardly in the "XY" vertical plane.

8. The guitar fulcrum as described in claim 6 further including a threaded yoke pivot pin used for attaching said yoke on said tang, whereby when said threaded yoke pivot pin is loosened, said yoke is free to pivot forward and backward in the "YZ" vertical plane.

9. The guitar fulcrum as described in claim 6 further including a threaded tang pivot pin used for attaching said tang on top of said leg pad, whereby when said threaded tang pin is loosened, said tang is free to rotate 360 degrees on top of said leg pad in an "XZ" horizontal plane.

10. The guitar fulcrum as described in claim 6 further including a pair of suction cups attached to the upper end of said struts, said suction cups adapted for attachment to the guitar.

11. A guitar fulcrum used for attachment to a body of a guitar and holding the guitar above a guitar player's leg when the player is in a seated position, the guitar fulcrum comprising:

a leg pad adapted for receipt on a top portion or a side portion of the player's leg; and a first strut having a lower end pivotally attached to a tang, said tang rotatably mounted on a top surface of said leg pad, said first strut having an upper end adapted for attachment to the guitar.

12. The guitar fulcrum as described in claim 11 further including a second strut, said second strut having a lower end pivotally attached to said tang, said second strut having an upper end adapted for attachment to the guitar.

* * * * *